United States Patent [19]

Humphrey et al.

[11] Patent Number: 4,995,591

[45] Date of Patent: Feb. 26, 1991

[54] RETAINING LOCK FOR CHAIN LINK FENCE SLATS

[76] Inventors: William D. Humphrey, 909 W. Riverview Ave., Selah, Wash. 98942; Harold Rothenberger, 1 Dorset Dr., Yakima, Wash. 98902

[21] Appl. No.: 399,419

[22] Filed: Aug. 25, 1989

Related U.S. Application Data

[63] Continuation of Ser. No. 366,247, May 26, 1989, abandoned, which is a continuation of Ser. No. 229,710, Aug. 8, 1988, abandoned.

[51] Int. Cl.[5] ..... B21F 27/00

[52] U.S. Cl. ..... 256/34; 256/19; 256/22

[58] Field of Search ..... 256/34, 24, 22, 19

[56] References Cited

U.S. PATENT DOCUMENTS

| | | | |
|---|---|---|---|
| 4,334,671 | 6/1982 | De Guise | 256/22 X |
| 4,722,514 | 2/1988 | Pettit | 256/19 X |
| 4,725,044 | 2/1988 | Clutt | 256/34 |

*Primary Examiner*—Andrew V. Kundrat

*Attorney, Agent, or Firm*—Fleit, Jacobson, Cohn, Price, Holman & Stern

[57] ABSTRACT

In a chain link fencing employing slats inserted vertically through adjacent links into an open channel which is inserted horizontally through the lowermost or uppermost course of links, a means of locking the slats to the channel to prevent easy removal of the slats from the fencing. Each slat is manufactured with a notch near one end thereof, and the channel is manufactured with a continuous barb along each free edge, one of which will engage the notch on the slat when the slat is inserted perpendicularly into the channel. For ease of assembly, the end of each slat nearest the notch is beveled.

8 Claims, 5 Drawing Sheets

RETAINING LOCK FOR CHAIN LINK FENCE SLATS

This is a continuation of application Ser. No. 366,247, filed May 26, 1989, now abandoned, which in turn is: a continuation of Ser. No. 229,710 filed Aug. 8, 1988, abandoned.

BACKGROUND OF THE INVENTION

1. Field of the Invention

It is common for owners and/or occupants of residential and commercial property to surround their property, in whole or in part, with a chain link fence to prevent or restrict the passage of people or animals across property lines. Chain link fencing does serve these purposes, but it has certain disadvantages. The appearance of chain link fencing is strictly utilitarian, and not necessarily attractive. Further, chain link fencing provides no privacy to the occupiers of the property, nor does it prevent the occupiers of the property from observing possibly distasteful views, such as that of passing traffic and the like.

To improve the appearance of chain link fencing, and to provide a degree of privacy to the occupiers of the property, it is a common practice to insert opaque slats between the links of the chain link fencing, usually in a vertical orientation. These slats occupy almost all of the lineal distance between the topmost and lowermost links of the fencing, and are usually restrained from falling through the fencing by means of an upwardly-concave channel inserted horizontally through the lowermost links of the fencing. The lower end of the slats rests in the channel.

The slat which is customarily used with chain link fencing is a flexible tube with a flattened cross-section, the long sides seen in cross-section being parallel, and the ends being approximately semi-circular. The width of the slat, as the word will be used hereinafter, is the width as seen in an external view; that is, the width of the slat is the distance between the extremes of the circular portions of the cross-section. The depth of the slat is the distance between the outer surfaces of opposite flattened sides of the slat.

Such slats are manufactured of polyethylene or similar plastic, although they can, and have been, made of wood or metal. The vast majority of such slats sold are, however, plastic. They are offered by manufacturers in various colors. There are various widths of slat to accommodate different sizes of fence mesh, but the depth of the slats is relatively uniform, and may vary from 0.310 inches (7.87 mm) to 0.315 inches (8.0 mm).

Chain link fences are subject to displacement of the slats, either by accident, or because of vandalism—the latter caused by persons who wilfully remove the slats and discard them, thereby creating an unsightly appearance, and destroying the privacy of the occupiers of the property.

2. Description of Related Art

Attempts to prevent the removal, intentional or otherwise, of slats from chain link fencing have consisted of methods or articles that require additional time to assemble into place. Such means require more of an assembler than merely inserting a channel along the bottom, and inserting the slats vertically through the fence links into the channel. For example, U.S. Pat. No. 4,725,044 of Cluff discloses a separate clip to be used with each slat and, in some embodiments, the use of a special lower channel as well as using one clip per slat.

SUMMARY OF THE INVENTION

One end of the slat of this invention is beveled so that one of the flattened sides extends beyond the other. The purpose of beveling the end is to facilitate insertion of the slat perpendicularly into the channel which will be described below. On the short side of the slat, and close to the beveled end, a notch is provided. The notch is formed by making an angular cut across almost the full width of the slat. The angle of the cut is approximately the same as the angle of the bevel. The depth of the notch is sufficient to accommodate one of the barbed edges of the channel which will be discussed below, but is, in any case, less than half the depth of the slat.

A channel, having a U-shape in cross-section, is provided for placement horizontally through either the uppermost links or the lowermost links of the fencing, but is installed preferably through the lowermost links, with the base of the channel at the bottom, and the walls of the channel extending upward from the base. The channel is so manufactured that the free ends of the channel walls tend to converge toward each other. A barb is formed along the free edge of each channel wall, the barbs extending inwardly for the entire length of the channel.

When the beveled end of a slat is inserted perpendicularly into the channel, one of the barbed edges of the channel will spring into the notch near the beveled end of the slat, and will engage with the lower edge of the notch so as to retain the slat within the channel. The engagement between the slat and the channel will be difficult to undo, because the chain links restrain the channel from being opened so as to release the slat. The result is that the slat can be removed from the channel only with difficulty, or by removing the channel itself.

The objects of this invention are to provide a locking slat-and-channel system that is just that, slats and channels, without the necessity to use any other items such as clips, and to allow the assembler simply to insert a channel in the usual manner, and to insert the slats easily, because of the beveled end, and without having to go through the motions of installing additional parts every time a slat is inserted into the fencing.

DESCRIPTION OF THE PREFERRED EMBODIMENT

Figure 1:
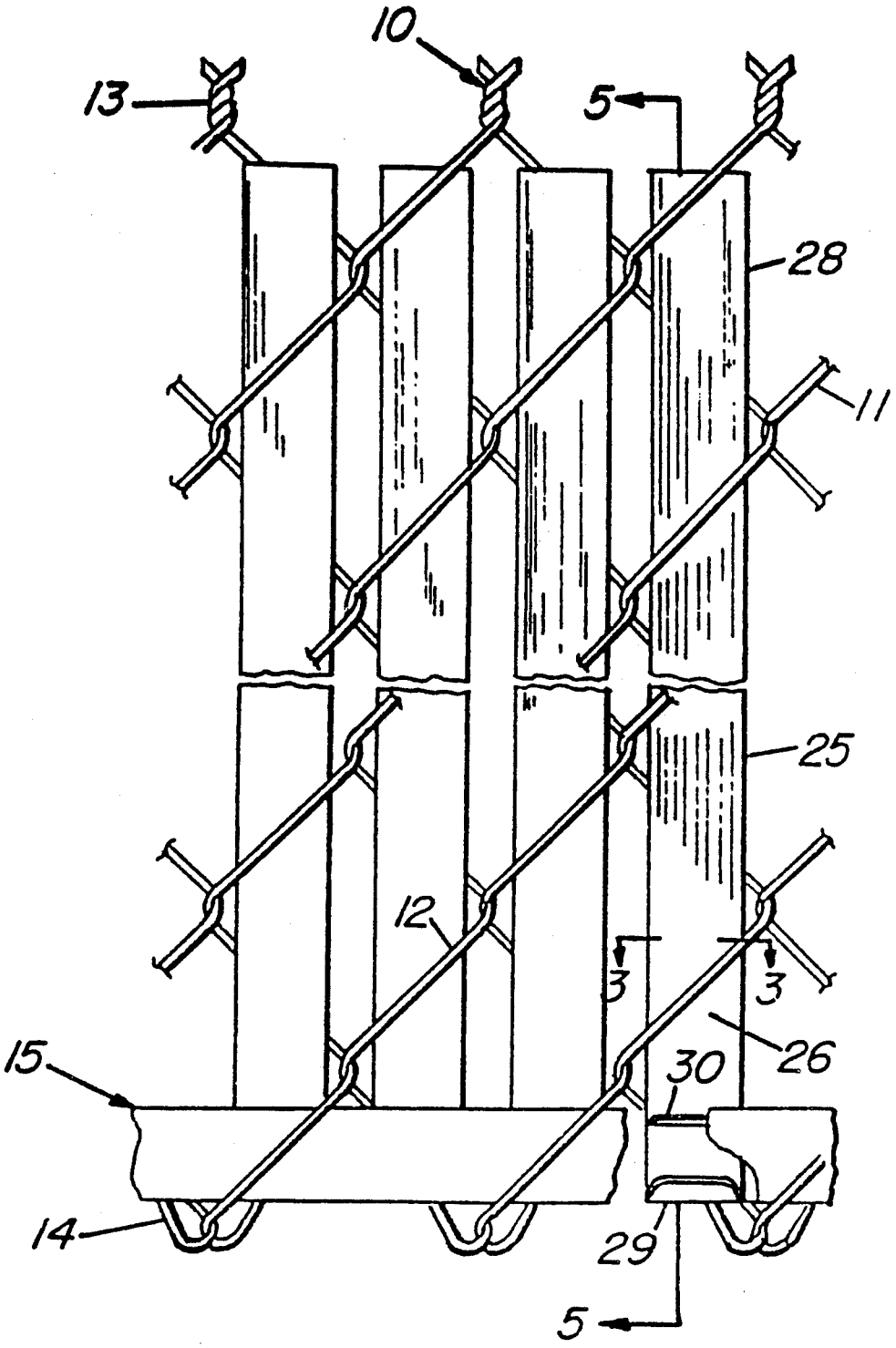
FIG. 1 is a fragmentary elevational view of a section of typical chain link fencing, partially cut away, showing the slat and channel assembly of this invention installed within the fencing.

A chain link fence 10, as illustrated in FIG. 1, consists of a series of wires 11, each of which is bent into a series of segments 12, each segment 12 being formed at right angles to the next. The wires 11 are interwoven with each other to form a mesh of rectangular openings, such openings being generally square. The wires 11 are twisted or linked together at the top 13 and bottom 14 of the fencing.

Figure 2:
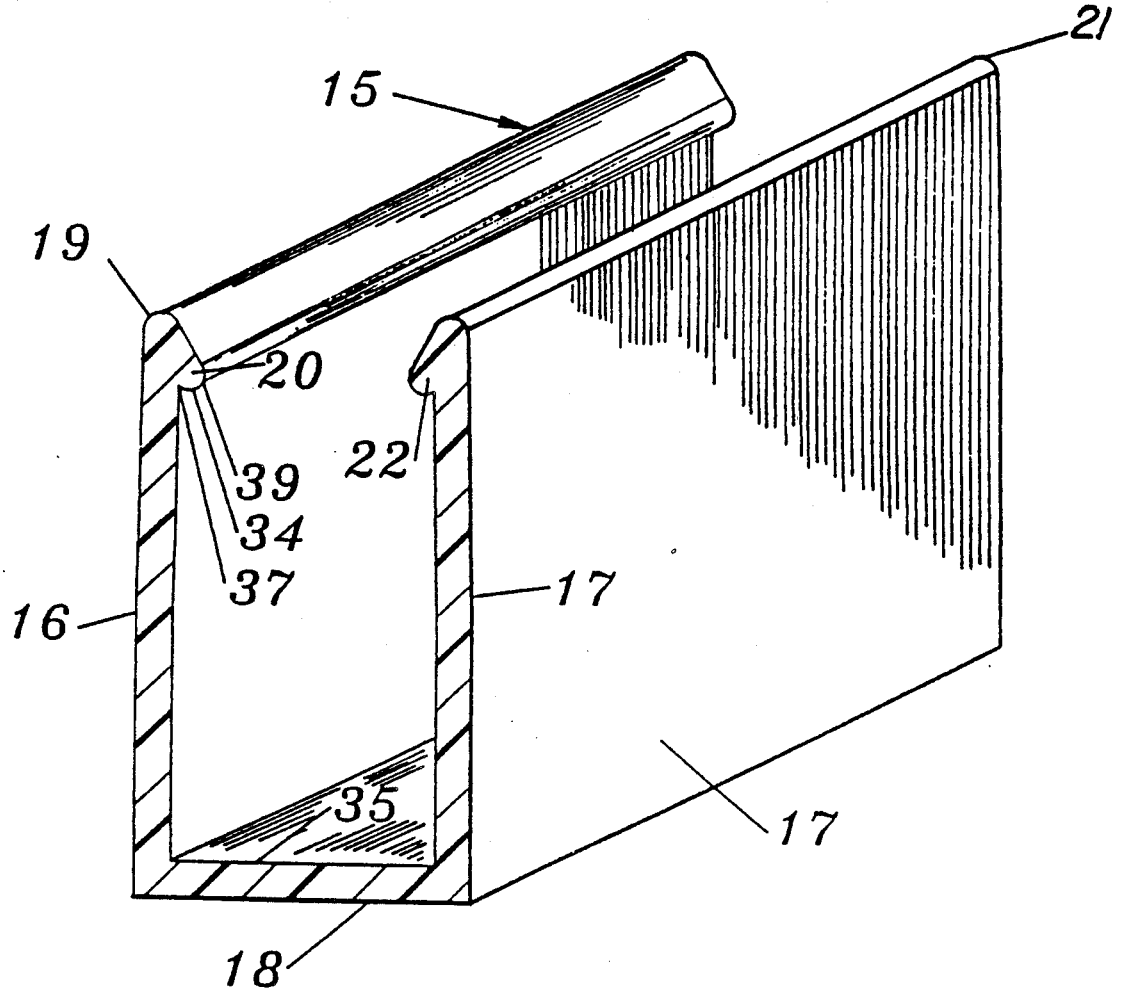
FIG. 2 is a fragmentary cross-sectional perspective view of a chain link fence channel embodying the features of this invention.
Figure 3:
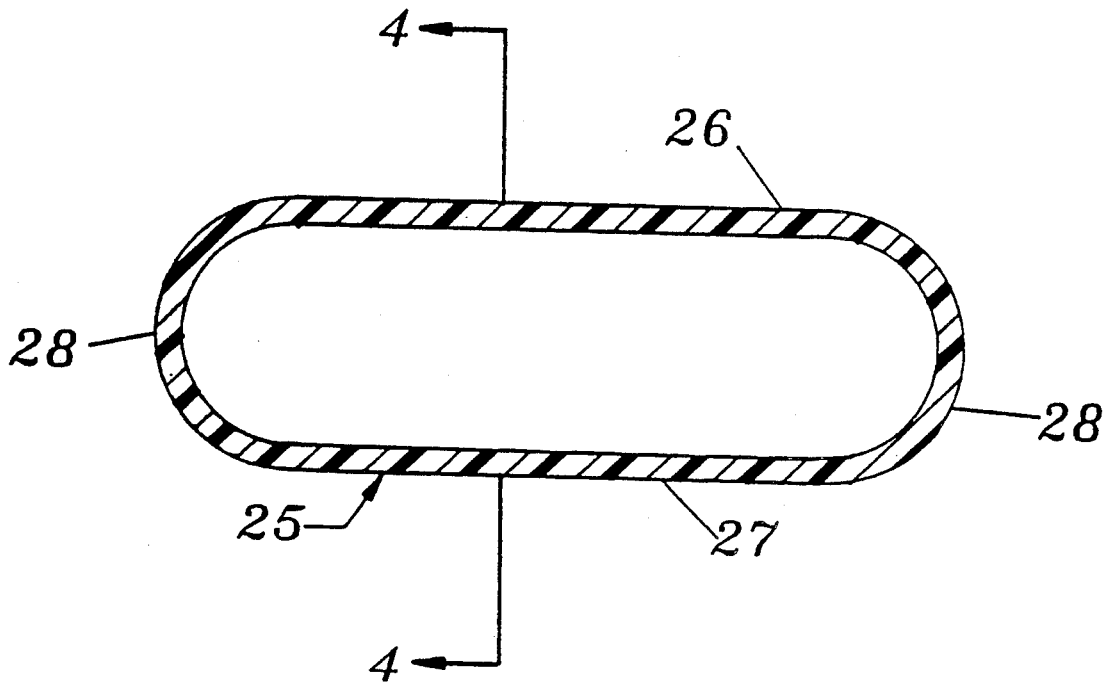
FIG. 3 is a cross-sectional view of a chain link fence slat taken at line 3—3 of FIG. 1.
Figure 5:
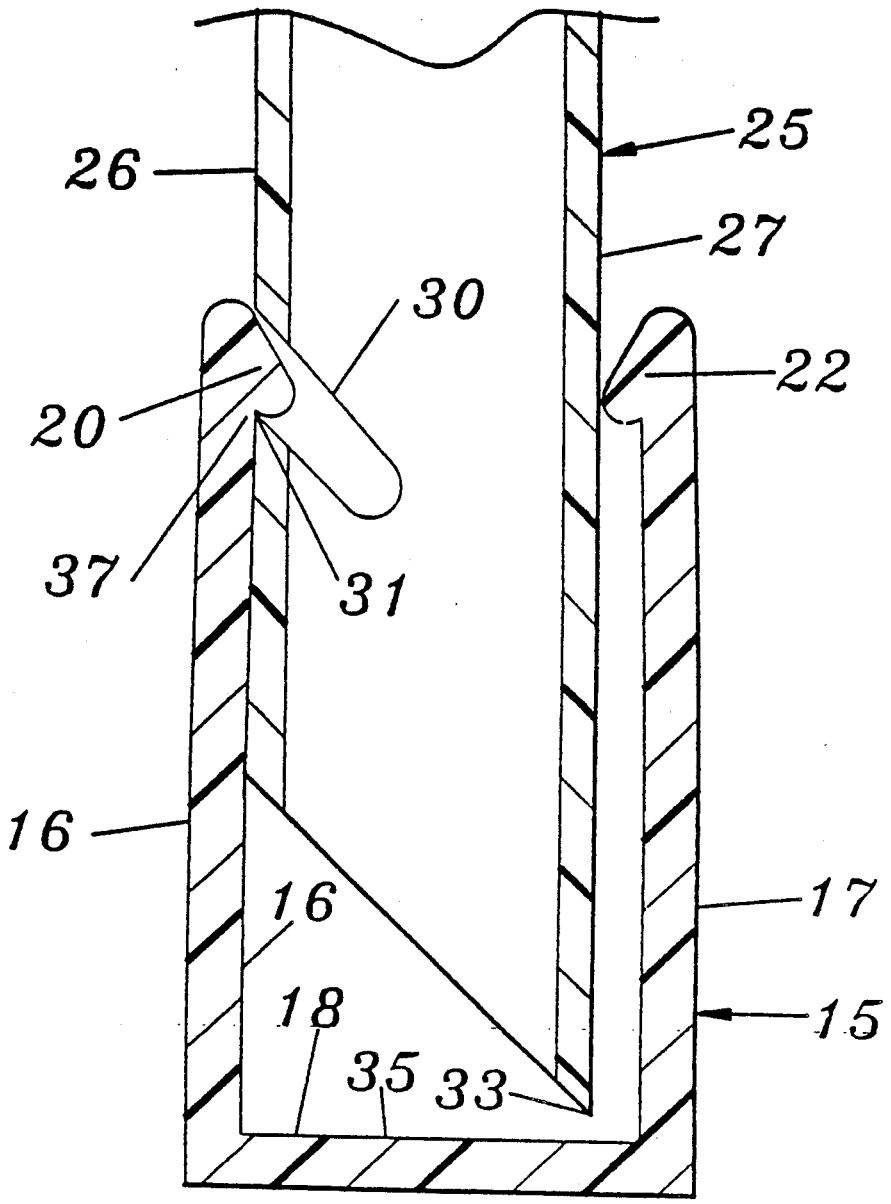
FIG. 5 is a fragmentary cross-sectional view of a slat and channel of this invention, locked together, taken at line 5—5 of FIG. 1.

A channel 15, illustrated in FIG. 2 and FIG. 5, has walls 16 and 17, which are mirror images of each other, and which extend perpendicularly from base 18. The free edge 19 of wall 16 terminates in an inwardly facing barb 20 which extends the full length of the free edge 19. The free edge 21 of wall 17 terminates in an inwardly facing barb 22 which extends the full length of free edge 21. The shortest distance between barbs 20 and 22 is less than the depth of a slat 25, which will be described in detail below. The elasticity of the polyethylene of which the channel 15 is manufactured insures that when walls 16 and 17 are forcibly spread apart, they will return to the inwardly inclining position. The channel 15 is installed horizontally into the lowest course of chain links in the fencing 10, so that the base 18 of channel 15 is lowermost, and the walls 16 and 17 extend upwardly from the base 18.

A slat 25 of the preferred embodiment has flattened sides 26 and 27, joined by rounded ends 28. One end 29 of the slat 25 is beveled so that side 27 is longer than side 26. The angle of the bevel is approximately 45 degrees, although the angle could vary by 15 degrees from that figure. A notch 30 having a lower edge 31 and an upper edge 32 is formed across side 26 of slat 25 by means of an angular cut with a circular saw or the like. The notch 30 could be formed on either side 26 or 27, and the invention would work just as well. For simplicity of manufacturing, however, the notch is located on side 26, and the angle of the cuts forming beveled end 29 and the notch 30 are approximately the same. In order to maintain the structural integrity and rigidity of the slat 25, the notch 30 extends less than halfway through the depth of the slat 25, but the depth of the notch 30 is, in any case, greater than the transverse distance from crease 37 to the innermost part of the corresponding barb. In other words, the depth of the notch 30 is sufficiently great to allow full engagement of barb 20 or barb 22 into the notch 30. The notch is so located that the longitudinal distance from lower edge 31 to the extreme end 33 on side 27 is less than the distance from the bottom 34 of barb 20 to the floor 35 of channel 15, or the distance from the bottom 36 of barb 22 to the floor 35 of channel 15.

Figure 4:
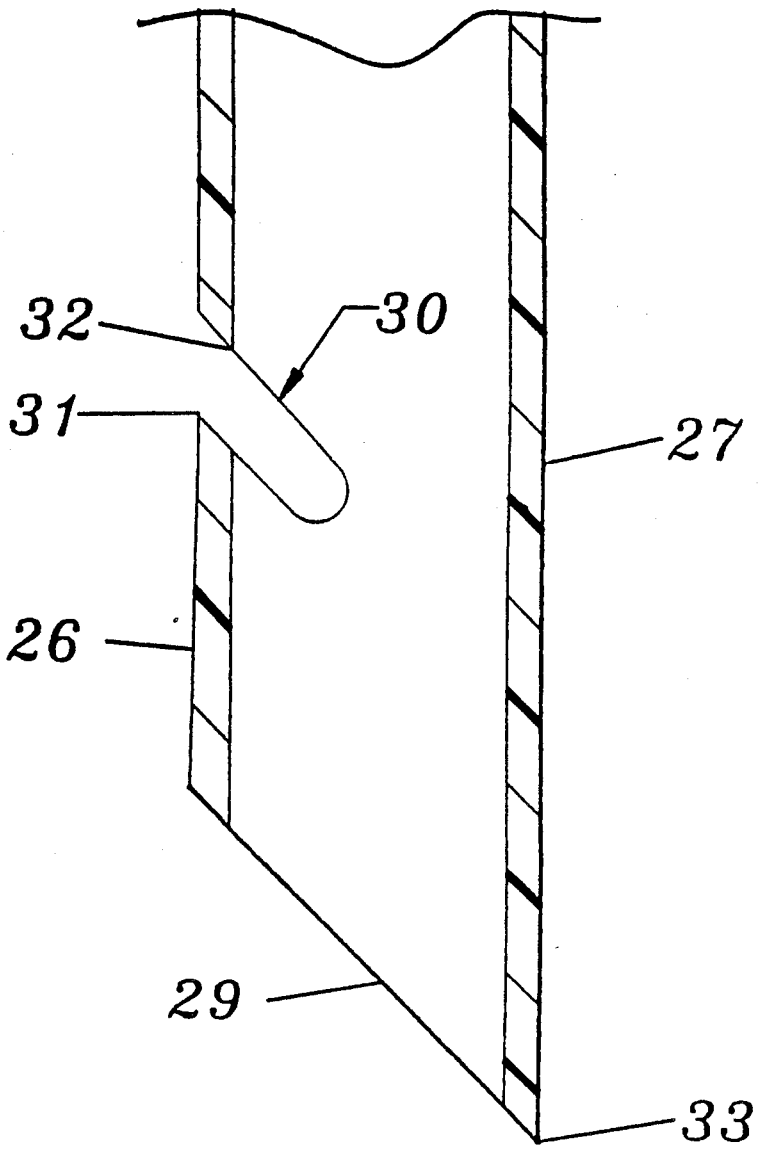
FIG. 4 is a fragmentary cross-sectional view of the chain link fence slat of this invention taken at line 4—4 of FIG. 3.

Slats 25 are inserted vertically downward through adjacent apertures between the segments 12 of the fencing 10 with the beveled end 29 of the slat 25 downward. The beveled end 29 enters the channel 15 between barbs 20 and 22. Because the depth of slat 25 is greater than the normal distance between barbs 20 and 22, the walls 16 and 17 of channel 15 are forced apart. As insertion of slat 25 into channel 15 continues, either barb 20 or barb 22 will engage in notch 30 before extreme end 33 of slat 25 comes into contact with floor 35 of channel 15. When lower edge 31 of slat 25 is inserted below the extreme low point 36 of barb 22 as illustrated in FIG. 4, barb 22 will spring in toward barb 20 and, if an attempt is made to withdraw slat 25, lower edge 31 will engage in crease 37 of barb 22, and barb 22 will serve to prevent withdrawal of the slat 25 from the channel 15. Inasmuch as the only way to remove the slat 25 intact from the channel 15 is to spread the channel walls 16 and 17 and, since such action is rendered difficult because of the restraint imposed on channel 15 by the wires 11, it can be seen that slat 25 cannot be removed from the fencing 10 by any simple means such as simply pulling the slat 25 up and out.

We claim:

1. In chain link fencing employing slats inserted vertically through adjacent rows of fencing links, each slat being elongated and having a longitudinal dimension with spaced opposite ends, a width dimension and a thickness dimension less than the width dimension, a means for securing the slats within the fencing, comprising:

a notch formed in each slat near one end thereof, the notch extending across the width dimension and partly through the thickness dimension; and a channel inserted through the fencing in a horizontal orientation to receive perpendicularly the ends of the slats having the notch formed nearby, the channel having inner surfaces and including a base portion and opposing walls, each of which has terminal edge portions spaced from said base portion, at least one of said terminal edge portions including an inwardly projecting barbed edge, the spacing between the respective terminal edge portions being less than said slat thickness dimension and said at least one barbed edge being engageable within the notch so as to lock the slat to the channel.

2. The securing means of claim 1 wherein the notch is angled toward said one end of the respective slat.

3. The securing means of claim 1 wherein the slats are of hollow tubular form.

4. The securing means of claim 1 wherein each said terminal edge portion includes a barbed edge.

5. The securing means of claim 4 wherein the distance between opposite inner surfaces of the channel at the base portion of the channel is greater than 0.315 inches (8.00 mm) and the distance between said barbed edges in a channel is less than 0.310 inches (7.87 mm).

6. The securing means of claim 4 wherein each slat has a plane surface opposite the notch and the other of said barbed edges is engageable with the plane surface when said at least one of the barbed edges engages the notch.

7. The securing means of claim 4 wherein the notch is angled toward said one end of the respective slat, wherein the slat has a plane surface opposite the notch and the other of said barbed edges is engageable with the plans surface when said at least one of the barbed edges engages the notch.

8. The securing means of claim 1 wherein the end of each slat nearest the notch is beveled.

* * * * *